United States Patent [19]

Greenleaf

[11] 3,971,221

[45] July 27, 1976

[54] BREAKWATER SYSTEM FOR CREATING ARTIFICIAL SANDBARS

[76] Inventor: Charles W. Greenleaf, P.O. Box 156, Lakeside, Mich. 49116

[22] Filed: Oct. 4, 1974

[21] Appl. No.: 511,990

[52] U.S. Cl. ..... 61/5

[51] Int. Cl.[2] ..... E02B 3/06

[58] Field of Search ..... 61/1, 3, 4, 5; 9/8 R

[56] References Cited

UNITED STATES PATENTS

| | | | |
|---|---|---|---|
| 307,393 | 10/1884 | Hyde | 61/5 |
| 3,222,871 | 12/1965 | Miller et al. | 61/5 |
| 3,691,774 | 9/1972 | Hard | 61/5 |

FOREIGN PATENTS OR APPLICATIONS

| | | | |
|---|---|---|---|
| 2,671 | 8/1868 | United Kingdom | 61/5 |

*Primary Examiner*—Paul R. Gilliam
*Assistant Examiner*—David H. Corbin
*Attorney, Agent, or Firm*—Granger Cook, Jr.; Jerold A. Jacover

[57] ABSTRACT

Means for forming, at the bottom of a body of water, a barrier to substantially reduce the impact of waves developed in the body of water are disclosed. The means comprise a flotation member having a leeward end, means defining a pivotable axis for said flotation member, and structural means for applying a force to said flotation means. The force applied by the structural means causes the flotation member to pivot about the axis and urge the leeward end into the body of water. The leeward end, when urged into the body of water, causes particulate matter suspended therein to gravitate to the bottom to form a barrier for the waves. The force applied by the structural means are adapted to be overcome when waves of a predetermined substantial size are developed, whereupon the flotation member is temporarily pivoted about the axis to a substantially horizontal position relative to the surface of the body of water to prevent damage to the flotation member when waves of substantial size are developed.

7 Claims, 6 Drawing Figures

BREAKWATER SYSTEM FOR CREATING ARTIFICIAL SANDBARS

BACKGROUND OF THE INVENTION

This invention generally relates to means for protecting beaches and shorelines from erosion by the ebb and flow of tides, seiches and waves. In particular, this invention relates to means for causing sand, suspended in a body of water, to gravitate to the seabed for the purpose of forming a shore-protecting sandbar. More particularly, the invention relates to means, adapted to float upon the surface, and further adapted to withstand the tremendous forces sometimes generated by a dynamic body of water.

For hundreds of years, mankind has been aware of the destructive force of tides, seiches and waves, and has conceived multifarious devices for reducing the adverse effects of these naturally-occurring phenomena. Though the prior art devices are far too numerous to individually specify, they can be generally categorized into several groups. One group relates to massive, bulk-fill breakwaters such as a dual-wall construct filled with concrete, rocks, earth, etc. These breakwaters tend to dissipate the energy of incoming waves by their sheer mass, thereby protecting nearby shores and beaches.

Another group of breakwater devices utilizes a frame, having a series of hinged baffles, secured to the seabed. The baffles are adapted to offer resistance to incoming waves, thereby reducing the destructive force of the water. The primary advantage of these devices is that they do not require the extraordinary mass used in more conventional breakwaters. As a result, they are easier to transport and erect, and are less costly to construct. On the other hand, these devices are more likely to be torn apart by large waves, or are more readily undermined at their foundations by the continuing ebb and flow of the water.

A third category of breakwaters provides means for depositing waterborne sand on the seabed for the purpose of creating an artificial sandbar. These structures generally consist of a water permeable barrier affixed to the bottom of the sea, adapted to block passage of much of the sand suspended in the water. This sand subsequently gravitates to the base of the barrier where it begins to form an artificial sandbar which itself serves as a breakwater. Like the second group of breakwaters described above, however, these devices do not readily maintain their structural integrity in rough water conditions, and are susceptible to subversion at their foundations. As a result, they often tear apart or become dislodged from the sea bottom long before an artificial sandbar can be created.

It is therefore a primary object of this invention to devise means for providing shores and beaches with the protective effect of massive, bulk-fill breakwaters without the concomitant expense, transportation and construction drawbacks. This is accomplished by depositing waterborne sand at predetermined points on the seabed to create an artificial sandbar. Such a sandbar can, of course, dissipate a substantial portion of the energy associated with an incoming wave which might otherwise erode or damage the shoreline.

It is another object of the invention to provide means for creating an artificial sandbar which do not readily tear apart or become dislodged from the seabed in rough water. As explained in more detail hereinafter, this is accomplished by providing flotation means which offer substantial resistance to incoming waves of moderate strength, thereby causing sand suspended in water to gravitate to the seabed. When waves of great strength appear, however, the flotation means remain on the surface of the water, providing little resistance but also sustaining minimal damage. Thereafter, when waves of moderate strength reappear, resistance is again provided causing more sand to drift to the bottom until an artificial sandbar is ultimately created.

SUMMARY OF THE INVENTION

The objects, features and advantages of the invention are achieved by means for forming at the bottom of a body of water a barrier to substantially reduce the impact of waves developed in the body of water. The means comprise flotation means having a leeward end, means defining a pivotable axis for the flotation means, and structural means for applying a force to the flotation means causing the flotation means to pivot about the axis and urge the leeward end into the body of water. The leeward end, when urged into the body of water, causes particulate material suspended therein to gravitate to the bottom to form a barrier for the waves. The force applied by the structural means is adapted to be overcome when waves of a predetermined substantial size are developed in the body of water, whereupon the flotation means are temporarily pivoted about the axis to a substantially horizontal position relative to the surface of the body of water to prevent damage to the flotation means when waves of such substantial size are developed.

In operation, the first or leeward end of the flotation means dips below the surface of the waer when waves of moderate strength appear. This tends to slow the flow of water, causing sand suspended thereby to drift to the bottom, forming the beginnings of an artificial sandbar. If the waves become too great, however, the upwardly urged second or windward end will catch the wave crest, and as the wave passes, urge the leeward end to the surface. The leeward end thus provides minimal resistance to the larger waves, and as a result, the flotation means can "ride out" the destructive force of such waves. When waves of moderate strength reappear, the leeward end of the flotation means will again impede the water flow, causing more sand to gravitate to the seabed. Ultimately, enough sand will drop to the bottom to form an artificial sandbar.

The resulting sandbar will typically have all of the shore protection features of the massive, bulk-fill breakwaters hereinbefore described. The sandbar, however, is produced at minimal cost, and without the obvious transportation and construction problems associated with the massive breakwaters of the prior art. Moreover, since the breakwater means of the invention are adapted to "ride out" the potentially destructive waves, they will not be readily torn apart or dislodged while the sandbar is being created. Further, after the artificial sandbar has been constructed, the breakwater means can be moved to other locations for creating additional sandbars.

BRIEF DESCRIPTION OF THE DRAWINGS

A greater understanding of the invention can be obtained by reading the following detailed description in conjunction with the accompanying drawings in which.

DETAILED DESCRIPTION OF AN EXEMPLARY EMBODIMENT OF THE INVENTION

As mentioned hereinbefore, the breakwater system of the invention provides means adapted to float in a body of water and cause sand, suspended in the water, to gravitate to the bottom for the purposes of creating an artificial sandbar. The resulting sandbar ideally provides substantial resistance to approaching tides, seiches and waves, thereby minimizing the adverse effects thereof.

Figure 1:
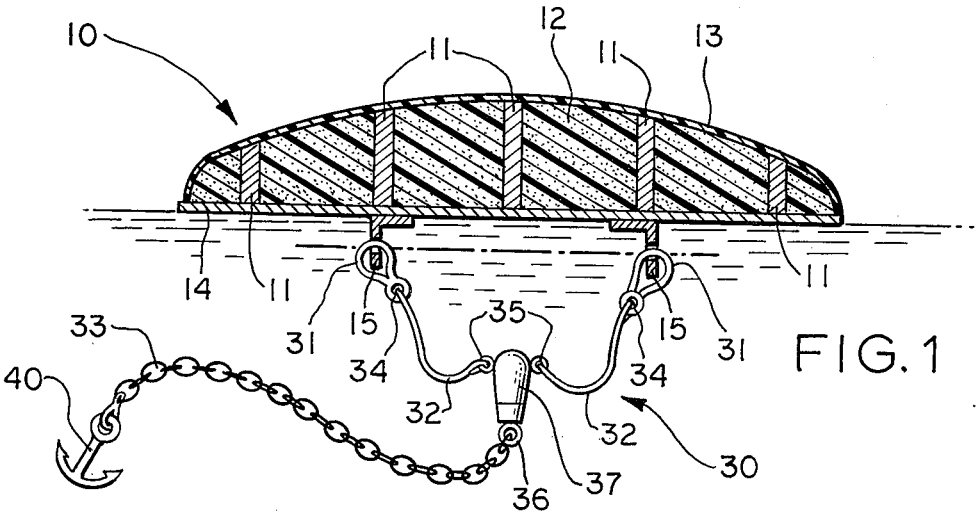
FIG. 1 is a sectional view of one embodiment of the breakwater system of the invention.
Figure 2:
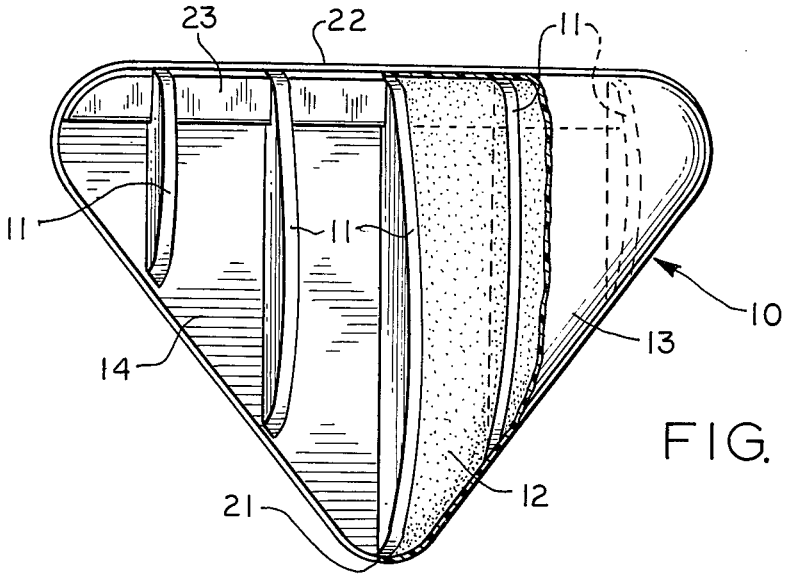
FIG. 2 is a perspective view, partially cutaway, of a portion of the embodiment shown in FIG. 1.
Figure 3:
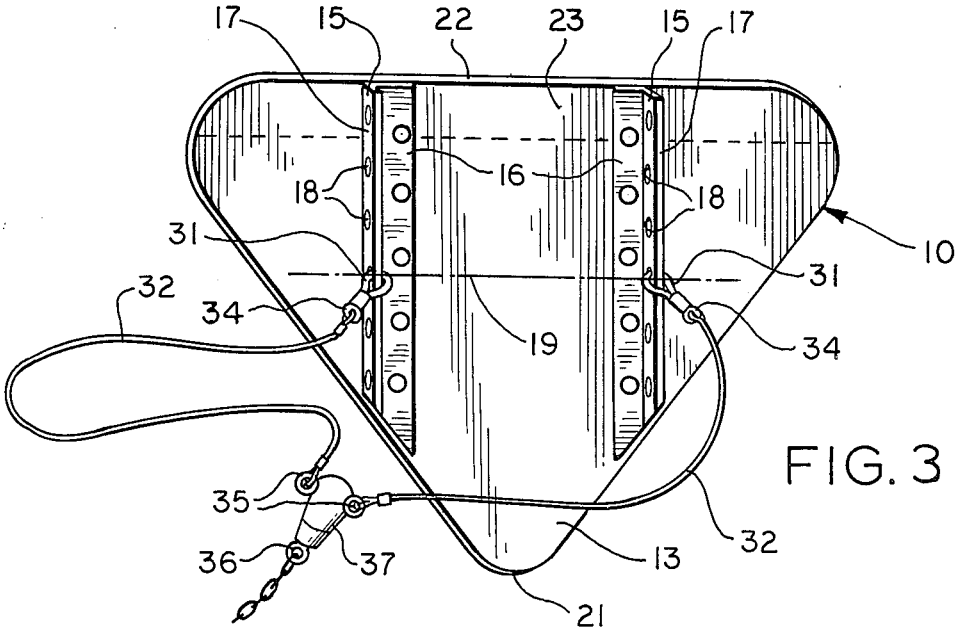
FIG. 3 is a perspective view, partially cutaway, of the bottom of the embodiment shown in FIG. 2.

An exemplary embodiment of this breakwater system is illustrated in FIGS. 1–3 of the drawings. More particularly, the breakwater system includes flotation means 10 adapted to float on a body of water. Flotation means 10 are preferably fabricated with a triangularly-shaped plywood bottom 14, having a base and an apex. The base of bottom 14 defines a first or leeward end 22, and the apex defines a second or windward end 21. A plurality of struts 11, secured to bottom 14 perpendicularly to leeward end 22, provides structural support for flotation means 10. Struts 11 are preferably convexly curved, i.e., tapered at the ends and humpbacked in the middle, giving flotation means 10 a blunt, pyramidal shape. In this exemplary embodiment, the interior of flotation means 10 is filled with bouyant material 12 such as styrofoam, and enclosed by a water repellent fiberglass skin 13.

In one aspect of the invention, the breakwater means further include fulcrum means 30, associated with flotation means 10. Fulcrum means 30 define an axis 19, parallel to leeward end 22, about which flotation means 10 are adapted to pivot. When properly deployed, flotation means 10 pivot about axis 19 so that leeward end 22 tips downwardly, and windward end 21 tips upwardly. To assure this downward tip of leeward end 22, ballast means 23, preferably comprising a length of dense material such as metal or plastic, are preferably secured to flotation means 10 near leeward end 22. Ballast means 23 thus subserves to urge leeward end 22 into the body of water and simultaneously subserves to urge windward end 21 above the surface.

In another aspect of the invention, fulcrum means 30 include means, disposed between leeward end 22 and windward end 21, preferably comprising a pair of elongated brackets 15 extending perpendicularly from leeward end 22. Brackets 15 have an L-shaped cross-section consisting of a stem member 17, having a plurality of openings 18, and a transverse member 16. Transverse members 16 are secured along bottom 14 equidistant from the centerline of flotation means 10. A pair of clasps 31, cooperates with corresponding openings 18 in brackets 15. It should be clear, however, that fulcrum means 18 can be fabricated so that clasps 31 can be secured to any preselected point between leeward end 22 and windward end 21, depending on the size of the waves anticipated in the body of water on which the device floats. Clasps 31 have an eye 34 adapted to receive mooring means, such as a mooring cable 32.

Fulcrum means 30 further include harness means 37 having a pair of mooring eyes 35 and an anchoring eye 36. Each of mooring eyes 35 are adapted to receive and hold respective mooring cables 32 from eyes 34 of clasps 31. Similarly, anchoring eye 36 is adapted to receive and hold an anchoring cable 33 secured to drag means 40 such as a Danforth model 8-S anchor having 3200 pounds of horizontal holding power in hard sand. As explained in greater detail hereinafter, drag means 40 serve to maintain flotation means 10 in position on a body of water to effect the formation of an artificial sandbar. Drag means 40 further provide tension along cable 33 which is evenly transferred by harness means 37 to each of mooring cables 32. Mooring cables 32, which are respectively coupled to corresponding openings 18 in brackets 15, thus applying a pivoting force to flotation means 10, simultaneously urging leeward end 22 downwardly into the body of water and windward end 21 upwardly above this surface of the water.

Figure 4:
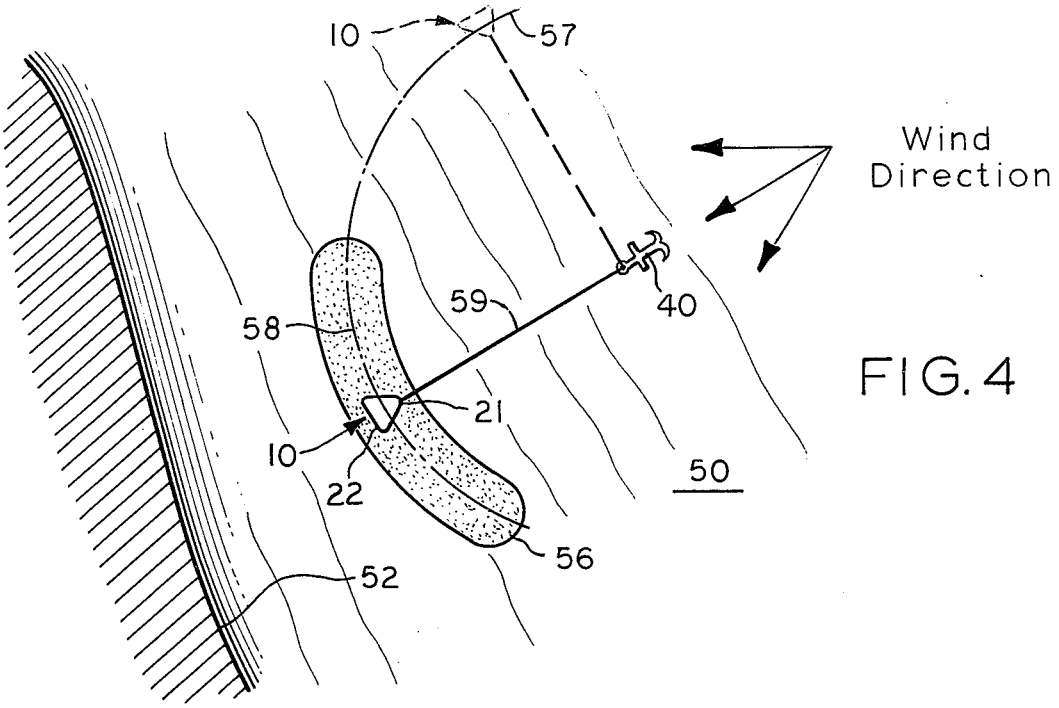
FIG. 4 is a schematic view of the embodiment of the breakwater system shown in FIG. 1, illustrating its deployment in a body of water.

In the deployment of the breakwater as illustrated in FIG. 4, flotation means 10 are placed in a body of water such as a lake 50, a suitable distance from the shoreline 52. Preferably, flotation means 10 are located over a naturally occurring submerged sand formation that frequently exists offshore. Drag means 40 are dropped to, and embedded in, the bottom of lake 50, thereby defining a radius of movement 59 for flotation means 10. When the wind is blowing from lake 50 toward shoreline 52, flotation means 10 will be positioned generally along an arc 58, with leeward end 22 facing shoreline 52. Accordingly, as exlained hereinafter, sand suspended by the waters of lake 50 will gravitate to the bottom thereof underneath arc 58, causing an artificial sandbar 56 to be created either by building up the naturally occurring sand formation, or by building up the lake bottom directly if no such formation exists.

In the presence of lake winds, flotation means 10 may be positioned along arc 58. It is possible, of course, that a change in wind direction can move flotation means 10 away from arc 58, and onto arc 57, for example. Under such circumstances, sand may begin to drift to the bottom of lake 50 underneath arc 57. However, after some time, the winds may return to the original direction indicated by the arrows in FIG. 4. As a result, flotation means 10 will be moved back in position along arc 58, causing additional sand to fall in the area of sandbar 57. Ultimately, enough sand will drift under arc 58 to complete sandbar 56, the amount of sand deposited under arc 57 or at other spurious points on the lake bottom being negligible.

Figure 5:
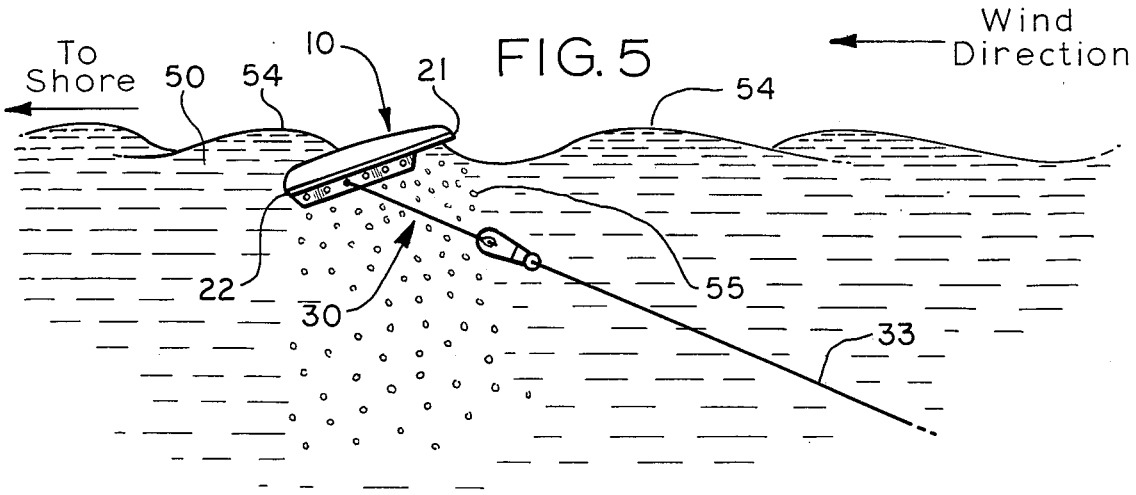
FIG. 5 is a schematic view of the embodiment shown in FIG. 1, illustrating its deployment in a body of water characterized by waves of moderate size.

FIG. 5 illustrates the manner in which flotation means 10 cause sand to gravitate to the bottom of a body of water. More particularly, FIG. 5 shows particles of sand 55 suspended in the water of lake 50 when the lake is characterized by moderate size waves 54. Flotation means 10 float on the surface with leeward end 22 being urged into the water, thereby impeding the shoreward flow of waves 54. This impediment dissipates enough of the energy associated with waves 54 to cause sand 55 to drift to the bottom of lake 50. Since this occurs only in a small, localized area of lake 50, sand 55 is primarily deposited and accumulated in one place to form sandbar 56.

As explained hereinbefore, fulcrum means 30 pivotably urge leeward end 22 of flotation means 10 into lake 50, and pivotably urge windward end 21 above the water's surface. Further, due to the orientation of flotation means 10, windward end 21 is the first portion of flotation means 10 to come in contact with waves 54. Waves 54, as they contact windward end 21 and begin to pass under flotation means 10, thus apply an upward force on the bottom of flotation means 10 near leeward end 22. If waves 54 are only of moderate size, however, the countervailing forces on flotation means 10 applied by fulcrum means 30, and the ballast near leeward end 22, overcome the upward forces from waves 54, thereby maintaining leeward end 22 beneath the surface of lake 50. As a result, leeward end 22 continues to dissipate the energy from waves 54, and sand 55 continues to form sandbar 56.

Figure 6:
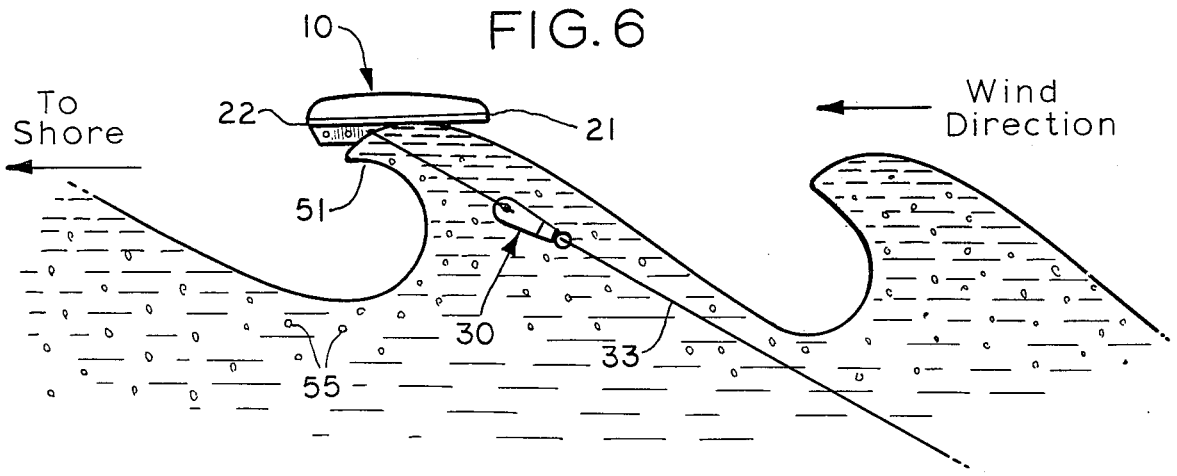
FIG. 6 is a schematic view of the embodiment shown in FIG. 1, illustrating its deployment in a body of water characterized by large size waves.

When potentially destructive waves occur, such as wave 51 in FIG. 6, the upward forces applied to flotation means 10 increase. As a result, these upward forces are sufficient to overcome the countervailing forces from fulcrum means 30 and from the ballast at leeward end 22 to push leeward end 22 to the surface of the water. The crest of wave 51 thus passes under flotation means 10, substantially unimpeded by leeward end 22. Accordingly, the flow of water is not sufficiently slowed to allow sand 55 to continue to gravitate to the bottom of lake 50, thereby temporarily halting the formation of sandbar 56. However, since flotation means 10, including leeward end 22, remain on the surface of the water during the passage of large waves such as wave 51, it will not be structurally damaged or torn apart. Moreover, the drag means will prevent flotation means 10 from being blown away. Thus, when the lake subsequently calms, and more moderate waves reappear, leeward end 22 can again dip below the surface to impede water flow, causing sand 55 to gravitate to the bottom to build sandbar 56.

After sandbar 56 has been completed, the breakwater system, including the flotation means, fulcrum means and drag means, can be retrieved from lake 50 and deployed at a different location. The completed sandbar 56 will, of course, remain in place to indefinitely provide substantial shore protection from tides, seiches and waves of various sizes and strengths.

Though the exemplary embodiment of the invention hereinbefore described is preferred, it will be apparent to those skilled in the art that other embodiments, disclosing numerous modifications and variations which do not part from the true scope of the invention, can be conceived. Each of these embodiments, along with such modifications and variations, are intended to be covered by the appended claims.

I claim:

1. Means for forming at the bottom of a body of water, a barrier to substantially reduce the impact of waves developed in said body of water, comprising:

flotation means, having a leeward end, a windward end and a tapered bottom surface whereby said leeward end is of greater length than said windward end so that a propagating wave passing under said bottom surface contacts an increasingly greater area thereof, thereby applying a proportionately greater upward force to said flotation means at said leeward end than at said windward end; said flotation means being adapted to have a first position wherein said leeward end intersects the plane of the surface of said body of water, and a second position wherein said flotation means floats upon the surface of said body of water;

means, defining a pivotal axis for said flotation means extending substantially parallel to said leeward end and being closer thereto than said windward end, for permitting said flotation means to be alternatively moved into said first position and said second position; and structural means for applying a predetermined force to said flotation means causing said flotation means to pivot about said axis and urge said leeward end into said body of water so that said flotation means are normally in said first position; said leeward end, when urged into said body of water, causing particulate material suspended therein to gravitate to the bottom to form a barrier for said waves; said predetermined force applied by said structural means being adapted to be overcome when waves of a predetermined size are developed in said body of water and applied to said bottom surface of said flotation means, whereupon said flotation means are temporarily pivoted about said axis to said second position to prevent damage to said flotation means and said structural means when waves of said predetermined size are developed.

2. The means defined in claim 1 wherein said structural means include ballast means, disposed substantially at said leeward end, subserving to urge said leeward end into said body of water.

3. The means defined in claim 1 further include a pair of bracket means, disposed on opposite sides of the center line of said flotation means defined by a line perpendicular to said pivotal axis; means, coupled to said brackets, for mooring said flotation means.

4. The means defined in claim 3 wherein each of said bracket means are secured to the bottom of said flotation means equidistant from said center line, and wherein said mooring means include a harness, and a pair of cables secured, respectively, between said pair of bracket means and said harness.

5. The means defined in claim 4 further include an anchor, adapted to lie on the bottom of said body of water, and means for securing said anchor to said harness.

6. The means defined in claim 2 wherein said flotation means is a triangularly-shaped flotatable member having a base defining said leeward end.

7. The means defined in claim 6 wherein said flotatable member contains bouyant material.

* * * * *